US006513902B1

(12) United States Patent
Amano et al.

(10) Patent No.: US 6,513,902 B1
(45) Date of Patent: Feb. 4, 2003

(54) APPARATUS FOR RESTORING INK JET RECORDING HEAD

(75) Inventors: Toshiaki Amano, Tokyo (JP); Tatsuo Sugawara, Tokyo (JP); Kunio Hakkaku, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/243,439

(22) Filed: Feb. 3, 1999

(30) Foreign Application Priority Data

Feb. 3, 1998 (JP) ..... 10-022326

(51) Int. Cl.[7] ..... B41J 2/165
(52) U.S. Cl. ..... 347/23
(58) Field of Search ..... 347/14, 23, 29–30, 347/33, 7, 92, 19

(56) References Cited

U.S. PATENT DOCUMENTS 4,558,326 A * 12/1985 Kimura et al. ..... 347/30
4,587,535 A * 5/1986 Watanabe ..... 347/23
4,625,220 A * 11/1986 Nagashima ..... 347/23 X
5,434,605 A * 7/1995 Osborne ..... 347/23
5,500,657 A 3/1996 Yauchi et al. ..... 347/9
5,621,444 A * 4/1997 Beeson ..... 347/92
5,625,385 A * 4/1997 Suzuki ..... 347/24
5,757,396 A * 5/1998 Bruner ..... 347/27

FOREIGN PATENT DOCUMENTS

EP 0 221 703 A1 5/1987 ..... B41J/3/04
EP 0 623 472 A2 11/1994 ..... B41J/2/175
JP 7-290721 A * 11/1995 ..... B41J/2/175

OTHER PUBLICATIONS

Japanese Abstract No. 54156539, dated Dec. 10, 1979.
Japanese Abstract No. 01150549, dated Jun. 13, 1989.
Japanese Abstract No. 62158053, dated.

* cited by examiner

*Primary Examiner*—Thinh Nguyen
(74) *Attorney, Agent, or Firm*—Sughrue Mion, PLLC

(57) ABSTRACT

There is disclosed an apparatus for restoring an ink jet recording head which can securely recover the ink jet recording head from the ink non-ejection condition caused by foreign particles or bubbles adhering inside the ink passage of an ejecting nozzle and which can prevent unnecessary bubbles from generating in the ink jet recording head. In the restoring operation, in which foreign particles are discharged together with ink from the ejecting nozzle by pressurizing the ink in an ink tank, an inner pressure of an ink supply passage is adjusted to reach a set pressure value.

22 Claims, 5 Drawing Sheets

A1
A2
A3
A4
A5
1.3atm
1.0
PRESSURE
L
M

ON
OFF
PRESSURIZING MEANS

ON
OFF
HEAD SOLENOID VALVE

ON
OFF
PIEZOELECTRIC ELEMENT

ON
OFF
PRESSURE RELEASE VALVE

ON
OFF
WIPER MOTOR

PRESSURE (OTHER THAN BLACK)
1.3atm
1.0
FIG.5Abk
PRESSURE (BLACK INK)
1.3atm
1.0

PRESSURIZING MEANS
ON
OFF

HEAD SOLENOID VALVE
ON
OFF

PIEZOELECTRIC ELEMENT
ON
OFF

PRESSURE RELEASE VALVE
ON
OFF

WIPER MOTOR
ON
OFF

TANK SOLENOID VALVE (BLACK)
ON
OFF

TANK SOLENOID VALVE (OTHER COLOR)
ON
OFF

APPARATUS FOR RESTORING INK JET RECORDING HEAD

BACKGROUND OF THE INVENTION

1. Field of the Invention

The present invention relates to an apparatus for restoring an ink jet recording head for use in an ink jet printer in which ink is ejected to a recording sheet from an ejecting nozzle to perform recording and an ink jet printer provided with the apparatus. More specifically, the present invention relates to a preferable apparatus for restoring an ink jet recording head for restoring the condition of ink non-ejection which is caused by the adhesion of foreign particles to the nozzle face or the occurrence of air bubbles in an ejecting nozzle, and an ink jet printer provided with the apparatus.

2. Description of the Related Art

In general, an ink jet printer is used as an output device of a computer, a word processor, or the like.

In a conventional ink jet printer, a carriage shaft is disposed in a direction parallel with a flat platen, and a reciprocatable carriage is disposed along the carriage shaft. Moreover, an ink jet recording head is mounted on the carriage to oppose to the platen in such a manner that a head nozzle of the ink jet head faces a printing face of the platen.

According to the above conventional ink jet printer, a recording sheet is conveyed between the platen and the ink jet head. While the carriage having the ink jet head mounted thereon moves along the platen, the nozzle of the ink jet head is operated on the basis of a predetermined printing signal, so that the desired ink is ejected or discharged from the nozzle toward the recording sheet on the platen. Thus, a desired image is recorded or printed on the recording sheet.

When such ink jet printer is used to perform recording, there is a case in which foreign particles adhere onto a nozzle face or air bubbles are mixed into or generated in the ink passage of the ejecting nozzle of the ink jet recording head. The sticking foreign particles or air bubbles clog or narrow a nozzle port of the ejecting nozzle, which causes ink non-ejection.

To solve the ink non-ejection problem, in the conventional ink jet printer, the foreign particles or bubbles are removed from the ejecting nozzle by a restoring apparatus. A suction method and a pressurizing method are known as restoring methods. In the suction method, an ink jet recording head is moved to a home position of a carriage, a cap is attached to and covers an ejecting nozzle, and suction is performed to make negative a pressure in the cap, so that the foreign particles are sucked together with ink from the ejecting nozzle to restore the non-ejectable condition. In the pressurizing method, the foreign particles are ejected or discharged together with the ink from the ejecting nozzle by pressurizing the ink in an ink tank, to restore the non-ejectable condition of the ink jet head.

In the suction method, in order to suck the ink by the cap, the ejecting nozzle needs to be hermetically sealed by contacting the cap closely to the ejecting nozzle, but it is difficult to keep hermetic the inside of the cap. Moreover, in the conventional pressurizing method, it is difficult to keep constant an ink ejecting pressure of each ejecting nozzle for restoration, and a dispersion of the ink ejecting pressure often happens. If an excessive inner pressure acts inside the normal ejecting nozzle, unnecessary and undesired air bubbles may be generated in the normal ink jet recording head.

SUMMARY OF THE INVENTION

The present invention has been accomplished in consideration of the aforementioned circumstances, and a first object of the present invention is to provide an apparatus for restoring an ink jet recording head which can securely recover the ink jet recording head from the ink non-ejection condition caused by foreign particles or air bubbles adhering inside an ink passage and which can prevent unnecessary air bubbles from generating inside the ink passage of the ink jet recording head. A second object is to provide an ink jet printer provided with the apparatus.

According to the present invention, the first object can be attained by adjusting to a set pressure value an inner pressure of an ink supply passage increased by operating pressurizing means. Specifically, the object is attained by the provision of an apparatus for restoring an ink jet recording head which performs image recording by ejecting ink droplets to a recording sheet from an ejecting nozzle of the ink jet recording head, comprising:

- non-ejection detecting means for detecting the occurrence of non-ejection of the ink drops from the ejecting nozzle to output a non-ejection signal;
- pressurizing means for increasing an inner pressure of an ink supply passage connected to said ink jet recording head;
- pressure measuring means for detecting the inner pressure of said ink supply passage; and
- control means for controlling said pressurizing means based on said non-ejection signal in such a manner that the inner pressure of the ink supply passage detected by said pressure measuring means reaches a set pressure value to eject ink.

Here, a piezoelectric ink jet system can be applied to the ink jet head. In the system, a piezoelectric element is provided to contact the ink supply passage. By applying a drive voltage, the piezoelectric element is deformed to increase the inner pressure of the ink supply passage, and ink within the ink supply passage is ejected from the nozzle. The non-ejection detecting means can use the piezoelectric element for use in the piezoelectric ink jet system. Specifically, when the piezoelectric element is deformed by a change of the inner pressure of the ink supply passage, voltage is generated between its both ends (piezoelectric effect). Therefore, an ejection/non-ejection condition can be determined by monitoring the voltage generated by the piezoelectric effect. Here, immediately after the ink is normally ejected, the inner pressure of the ink supply passage is largely varied by movement of the ink. When no ink is ejected, however, no ink moves in the ink supply passage, and the variation of the inner pressure is reduced. When the voltage generated by the piezoelectric effect of the piezoelectric element is largely varied, it can be determined that ejection is normally performed. When the variation is reduced, non-ejection can be determined.

For the control means, when the non-ejection detecting means detects the ink non-ejection to output the non-ejection signal, the inner pressure of the ink supply passage is increased to a preset pressure value, and the piezoelectric element is then actuated, so that the ink is ejected from the ejecting nozzle. The foreign particles or air bubbles can thus securely be removed from the ink supply passage. In this case, when the drive voltage of the piezoelectric element is set to a voltage higher than the drive voltage at the time of normal operation, e.g., about twice the normal drive voltage, the ink ejecting pressure is further raised, and the foreign particles or air bubbles can be removed more securely.

In the restoring operation, it can simultaneously be judged whether or not the amount of ink remaining in the ink supply passage is lacking; i.e., whether or not there is remaining ink. In general, a pressure decreasing rate in a stationary state of the ink supply passage after once pressurized is relatively small, when a sufficient amount of ink remains in the ink supply passage. In contrast, the pressure decreasing rate is relatively large, when a lesser amount of the ink remains in the ink supply passage. The presence of remaining ink is determined by using the pressure decreasing rate which is changed by the remaining amount of ink. More specifically, in the restoring operation, after the ink supply passage is pressurized up to the predetermined pressure value, the piezoelectric element is actuated for a short time to discharge the foreign particles or bubbles. Additionally, during and after the operation of the piezoelectric element, the pressure decreasing rate is monitored. When the pressure decreasing rate is more than a predetermined rate, or when the pressure in the ink supply passage decreases to be less than a predetermined pressure, it is judged that there is no remaining ink.

The ink jet recording head may be provided with a buffering chamber for separating the air bubbles mixed into the ink. In order to adjust the amount of air accumulated in the buffering chamber with a head solenoid valve, the air amount adjustment of the buffering chamber may be performed prior to the restoring operation. Because there are cases in which, when the amount of air accumulated in the buffering chamber is equal to or more than a specified value, the air bubbles mixed into the ink cannot be separated, and non-ejection is caused. Therefore, in this case, after the ink supply passage is once pressurized in response to the non-ejection signal, and the head solenoid valve is opened to exhaust unnecessary air from the buffering chamber, the ink supply passage is again pressurized to perform the original restoring operation.

After the restoring operation, a nozzle face or tip end of the ejecting nozzle of the ink jet recording head may be cleaned with a wiper. In the ordinary restoring operation, after the ink supply passage is pressurized to eject the ink via the ejecting nozzle, the inner pressure of the ink supply passage is lowered. In this case, the ink droplets adhere to or remain in the tip end of the ejecting nozzle. Moreover, the ink or the foreign particles may adhere to a periphery of the nozzle port of the ejecting nozzle. The wiper for removing the ink or foreign particles from the ejecting nozzle can be operated during a time for releasing the inner pressure of the ink supply passage, after the restoring operation is completed.

The pressurizing means may be constituted by a pressurizing pump or air pump for supplying pressurizing air to the ink tank. In this case, the pressure measuring means may be formed by a pressure sensor for detecting an air pressure in a pressurizing air channel connecting the pressurizing pump and the ink tank.

When a plurality of ink jet recording heads and ink tanks are arranged for different colors, there are provided a pressure junction section which is pressurized by one pressurizing pump, and one pressure sensor and one pressure release valve connected to the pressure junction section. The pressure junction section may be separately connected to the tanks via tank solenoid valves. In this case, when the pressure junction section is maintained at a constant pressure, the constant pressure can be fed to an arbitrary ink tank by opening the associated tank solenoid valve. Therefore, different from a case in which the ink tanks are separately provided with pressurizing pumps, pressure sensors and pressure release valves, the structure can be simplified.

When there are provided a plurality of ink jet recording heads, each ink jet recording head is detected for the ink non-ejection condition, and the restoring operation can be applied only to the non-ejecting ink jet recording head. In this case, wasteful consumption of ink is minimized.

For the control means, after the inner pressure of the ink supply passage raised by operating the pressurizing means is once lowered, the inner pressure of the ink supply passage may be raised to the set pressure value again by operating the pressurizing means. In this case, the inner pressure of the ink jet recording head can easily and securely be raised to the set pressure value only by performing pressurizing in two stages.

According to the present invention, the second object can be attained by an ink jet printer in which ink is supplied to an ink jet recording head from an ink tank, and ejected to a recording sheet via an ejecting nozzle based on a predetermined recording signal to perform recording, comprising the aforementioned apparatus for restoring the ink jet recording head.

DETAILED DESCRIPTION OF THE PREFERRED EMBODIMENTS

Preferred embodiments of the present invention will be described hereinafter with reference to FIGS. 1 to 5.

Figure 1:
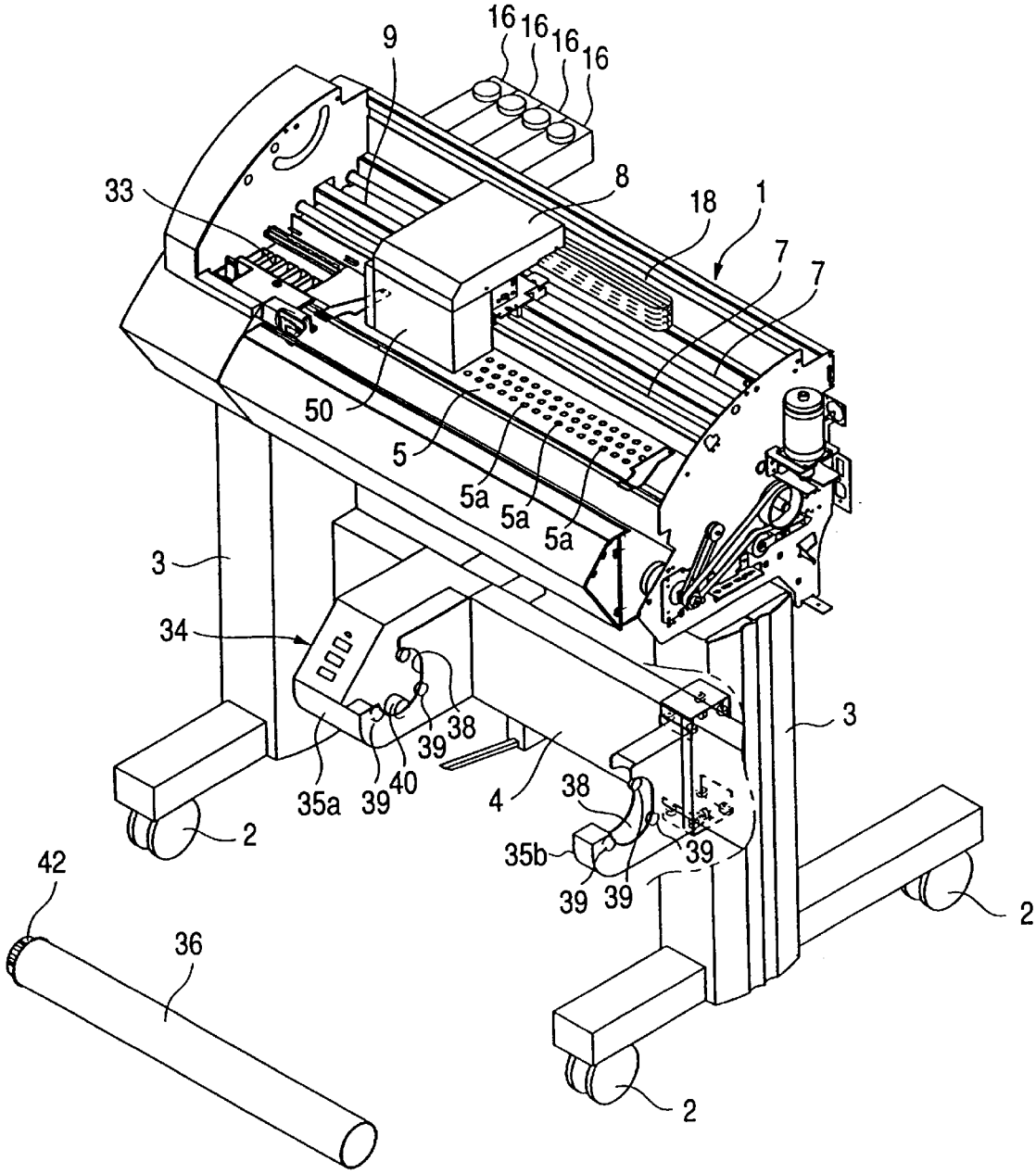
FIG. 1 is a perspective view showing one embodiment of an ink jet printer provided with an apparatus for restoring an ink jet recording head according to the present invention.

FIG. 1 shows a first embodiment of an ink jet printer provided with an apparatus for restoring an ink jet recording head according to the present invention. A printer unit 1 is supported by a pair of stands 3, 3 to which a plurality of casters 2 are attached. The stands 3, 3 are interconnected via an auxiliary frame 4 which is positioned in substantially the middle of each stand 3 in the vertical direction.

A plate-like platen 5 is oriented upward in the printer unit 1. A multiplicity of suction holes 5a are formed in a top surface of the platen 5. When a recording sheet (not shown) is fed on the surface of the platen 5, the sheet is sucked onto the top surface of the platen 5 by the action of the negative pressure in the suction holes 5*a*. Accordingly, the recording sheet is fixedly adhered to the top surface of the platen 5. A pair of carriage shafts 7, 7 extending parallel relative to the longitudinal direction of the platen 5 are disposed behind the platen 5 in the printer unit 1. A reciprocable carriage 8 is disposed along the carriage shafts 7. A carriage drive belt 9 positioned between the carriage shafts 7 is connected to the carriage 8. The carriage drive belt 9 is operated by a drive device (not shown) and, as a result, the carriage 8 is reciprocated along the carriage shafts 7.

Figure 2A:
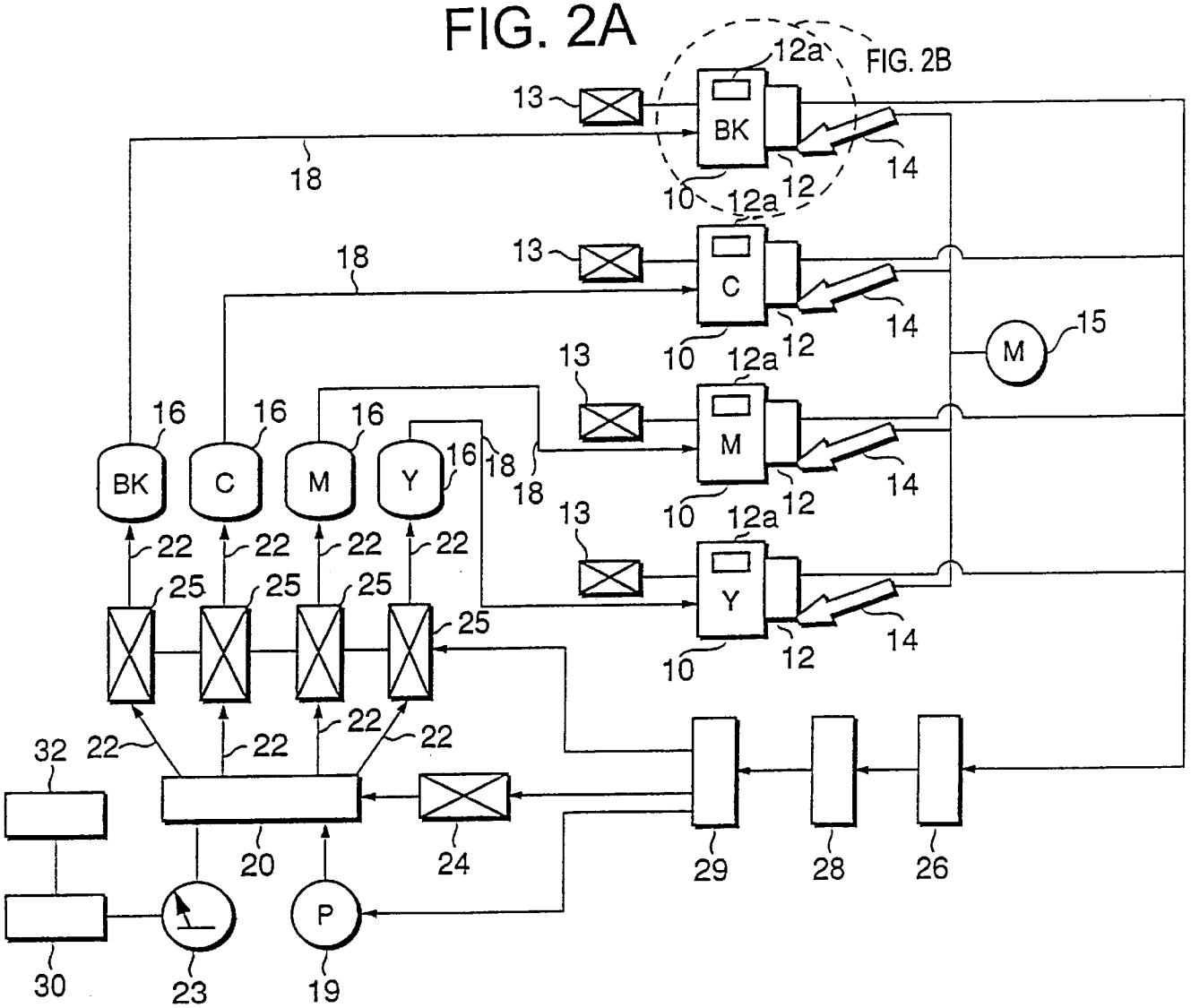
FIGS. 2A and 2B are a schematic circuit diagram and an enlarged view, respectively, showing a main section of the ink jet printer provided with the apparatus for restoring the ink jet recording head in the embodiment of the present invention.

A head unit 50 is disposed to the carriage 8 to face the platen 5. Four ink jet recording heads 10 are assembled in the head unit 50. Ink ejecting nozzles 12 are assembled in the ink jet recording heads 10 to face a recording surface of the platen 5. In the first embodiment, the four ink jet recording heads 10 are provided for four colors: yellow (Y); magenta (M); cyan (C); and black (BK). Each ink jet recording head 10 has two ejecting nozzles 12. Specifically, there are provided eight ejecting nozzles 12 in total. For the sake of simple description, FIG. 2A shows four ejecting nozzles 12. A piezoelectric element 1201 is disposed to an ink supply passage in the ejecting nozzle 12. The piezoelectric element is attached to contact on outer peripheral wall of the ink supply passage. The ink inside the ink supply passage is pressurized by applying a drive voltage to the piezoelectric element to deform the piezoelectric element. As a result, a predetermined amount of ink can be jetted via the ejecting nozzle 12 positioned on a tip end of each ink supply passage.

In each ink jet recording head 10, a buffering chamber 12*a* for adjusting a pressure is formed behind the ejecting nozzle 12. The ink is stored in the buffering chamber 12*a*, and a constant amount of air is sealed in an upper portion of the buffering chamber. Air bubbles contaminated in the ink fed to the ink jet recording head 10 via the ink supply passage are captured in the buffering chamber 12*a*, and prevented from entering the ejecting nozzle 12. The buffering chamber 12*a* also serves as a damper for absorbing and damping ink waving caused in the ink jet recording head 10 by the reciprocating motion of the carriage 8. A head solenoid valve 13 is provided above the buffering chamber 12*a*. When the head solenoid valve 13 is opened, excessive air accumulated in the buffering chamber 12*a* flows out, so that the amount of air in the ink jet recording head 10 becomes constant.

A wiper 14 is swingably provided opposite to an ejection face of the ejecting nozzle 12 of the ink jet recording head 10 for cleaning ink drops or dirt adhering to the ejection face. The wiper 14 is operated by a wiper motor 15.

Figure 2B:
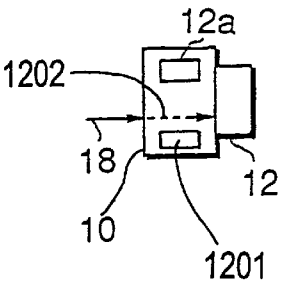

In the first embodiment, there is provided one wiper motor 15, which is operatively connected to the wiper 14 for each ink jet recording head 10, as shown in FIGS. 2A and 2B, to rock the wiper 14. However, each wiper 14 may separately be provided with the wiper motor 15.

Four ink tanks 16, each thereof for each color, are disposed on one side in the rear face of the printer unit 1. The ink tank 16 is communicated with the ink jet recording head 10 via a tube 18. The tube 18 supplies ink to each ink jet recording head 10 from each ink tank 16 via the carriage 8.

A pressurizing pump or another pressurizing means 19 is connected to the ink tanks 16 via the pressure junction section 20. The ink tanks 16 are connected to the pressure junction section 20 via pressurizing air channels 22. The pressurizing means 19 supplies air into the ink tanks 16 via the pressurizing air channels 22, and raises inner pressures of ink supply passages in the tubes 18, ink jet recording heads 10, and the like via the ink.

The pressure junction section 20 disposed between the pressurizing means 19 and the ink tanks 16 is connected to a pressure measuring device or means 23 for measuring a pressurizing force of the pressurizing means 19. The pressure junction section 20 is also connected to a pressure release or relief valve 24. The pressure release valve 24 releases the pressure, which has been applied by the pressurizing means 19, to the outside.

On the other hand, a tank solenoid valve 25 is interposed in each pressurizing air channel 22 connecting each ink tank 16 and the pressure junction section 20. The tank solenoid valves 25 are opened, when non-excited, to supply air into the ink tanks 16 from the pressurizing means 19. The tank solenoid valves 25 are closed when excited to stop the air supply into the ink tanks 16.

In normal operation, the tank solenoid valves 25 are closed, and the pressurizing means 19 supplies air to each ink tank 16 to increase the inner pressure of the ink supply passage at the time of recording of the recording sheet. In this case, the inner pressure indicates a low constant pressure value (e.g., 1.3 atm). When the air bubbles or foreign particles or matters adhering inside of the ink supply passage of the ejecting nozzle 12 cause an ink non-ejection condition, this condition is detected as described later. The ink tank 16 is pressurized to adjust the inner pressure to a set pressure value (e.g., 1.35 atm), which is higher than an inner pressure at the time of ordinary recording. In the first embodiment, the high set pressure value is preferably kept in the range of about 1.25 to 1.4 atm, so that the foreign particles or bubbles are securely removed from the ejecting nozzle 12 and that the ejecting nozzle 12 is prevented from being broken by the excess pressure.

The head solenoid valves 13, the tank solenoid valves 25, and the pressure release valve 24 are opened/closed by control means 29 described later at predetermined timings.

The ink non-ejection condition is detected as follows:

In the ink supply passage positioned inside the ink jet recording head 10, when the ink flows, the piezoelectric element is distorted. This distortion generates a voltage across both sides of the piezoelectric element. Therefore, each piezoelectric element is connected to voltage detecting means 26 for detecting the voltage across both ends. The ink flow, i.e., ink ejection can be detected based on a change of the detected voltage.

The voltage detecting means 26 is connected to non-ejection detecting means 28 for determining the ink ejection from the detected voltage change. When the specified ejecting nozzle 12 is clogged or inhibited from ejecting by air bubbles, the non-ejection detecting means 28 detects the non-ejection state from the fact that the voltage change across both ends of the piezoelectric element is small, and transmits to the control means 29 a non-ejection signal indicative of the non-ejection state of the specified ejecting nozzle 12.

Upon receiving the non-ejection signal from the non-ejection detecting means 28, the control means 29 supplies a drive signal to the pressurizing means 19 to pressurize the ink tank 16.

On the other hand, the pressure measuring means 23 is connected to remaining ink judgment means 30 for judging the presence of ink in the ink tank 16. The ink tank 16 is pressurized by the pressurizing means 19 until the inner pressure reaches the set pressure value. When the pressurizing is stopped, the remaining ink judgment means 30 monitors a decreasing rate of the inner pressure. Subsequently, the remaining ink judgment means 30 judges whether or not there is remaining ink in the ink tank 16 by detecting the magnitude of the inner pressure decreasing rate, in other words, by detecting whether the inner pressure is larger or smaller than a predetermined pressure value after a set time elapses.

Specifically, when the ink tank 16, tube 18 or another ink supply system is filled with the ink, the inner pressure decreasing rate is small, and the inner pressure gradually decreases. On the other hand, if there is no ink in the ink supply system, the inner pressure rapidly decreases. This property is used to determine the presence of remaining ink.

Moreover, a set time for detecting the inner pressure decreasing rate after pressurizing may be shorter than a time required until the inner pressure becomes equal to or less than the predetermined pressure value when the ink supply system is normally filled with the ink.

Figure 3:
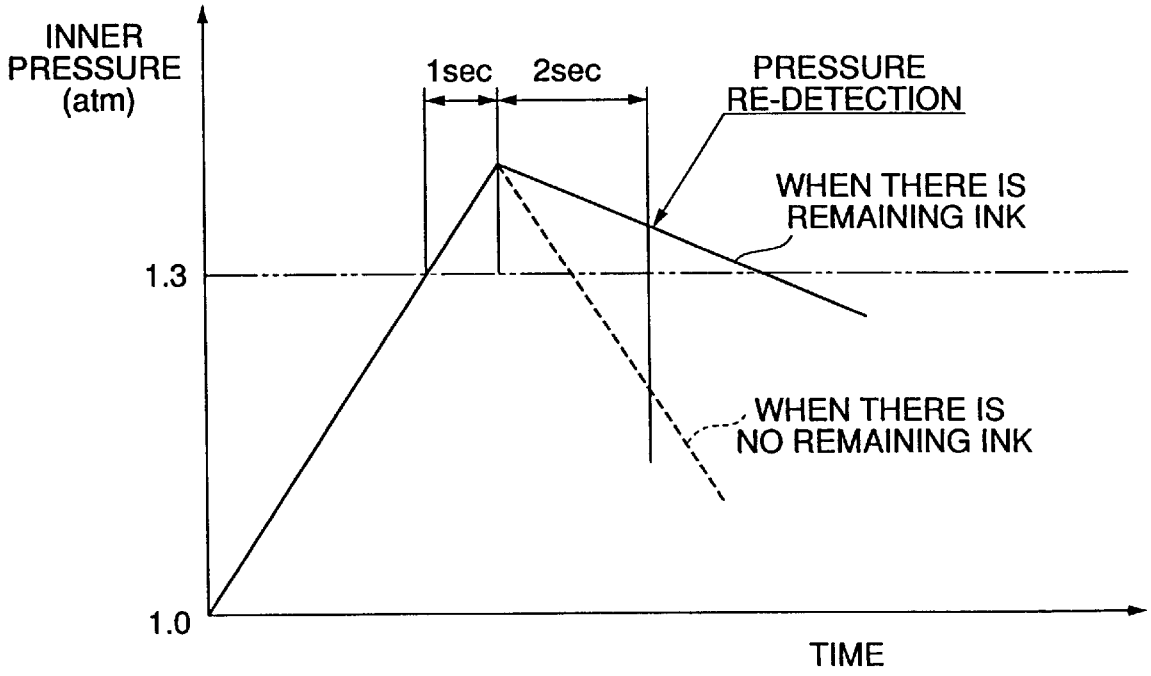
FIG. 3 is an explanatory view of a principle for judging the presence of remaining ink by remaining ink judgment means in the embodiment.

This principle will next be described in more detail with reference to FIG. 3. After the inner pressure of the ink tank 16 is increased by the pressurizing means 19, and it is detected by the pressure measuring means 23 that the inner pressure is increased up to 1.3 atm, pressurizing is further continued for one second, and completed. When two seconds elapse after the pressurizing is completed, the inner pressure is detected again. Subsequently, when the inner pressure is more than the predetermined pressure value of 1.3 atom, it is judged that there is ink in the ink tank 16. Moreover, when it is less than 1.3 atm, it is judged that there is no ink in the ink tank 16.

Additionally, the remaining ink judgment means 30 incorporates therein a timer (not shown) for measuring a time from when the pressurizing by the pressurizing means 19 is completed until two seconds elapse and detection is then performed again.

In order to simplify the structure, in the first embodiment, the pressurizing means 19 for restoring the ink non-ejection condition is used as the remaining ink judgment means 30. Specifically, the inner pressure increased by the pressurizing means 19 is used, and the presence of remaining ink is judged by referring to the decreasing rate of the inner pressure. However, the present invention is not limited to the use of the pressure at the time of restoration. Even at any time other than the time of restoration, the ink tank 16 may be pressurized, so that the presence of remaining ink is judged.

To enhance correctness, the judgment of the presence of remaining ink is preferably repeated several times. This is because when the ink remains not in the ink tank 16, but in the tube 18, this state fails to appear in inner pressure decreasing tendency, which may result in misjudgment.

In the first embodiment, the control means 29 and the remaining ink judgment means 30 are separately and individually constructed, but they may be integrally constructed in such a manner that the presence of remaining ink is judged by the control means 29.

The remaining ink judgment means 30 is connected to remaining ink display means 32. When it is judged that there is no ink in the ink tank 16, the remaining ink display means 32 indicates an error display or emits an alarming sound to call to the user's attention, or stops the operation of the ink jet printer. Conversely, when it is judged that the ink remains, the remaining ink display means 32 indicates that there is remaining ink, or emits no alarming sound.

One side (left side in FIG. 1) of the platen 5 of the printer unit 1 is set in a home position of the ink jet recording head 10. A cap 33 is disposed in the position corresponding to the home position. The cap 33 covers the ejecting nozzle 12, when not in use, to prevent the drying of ink inside the ejecting nozzle 12 and the attachment of foreign particles. Moreover, the cap 33 sucks and collects by a negative pressure the ink ejected by the restoring operation of the ejecting nozzle 12 of the ink jet recording head 10.

The auxiliary frame 4 is provided with a wind-up mechanism 34. The wind-up mechanism 34 is provided with a pair of supports 35*a*, 35*b* positioned on opposite sides of the auxiliary frame 4. In the embodiment, one support 35*a* (left support in FIG. 1) is fixed to the auxiliary frame 4, while the other support 35*b* can be moved along the auxiliary frame 4.

A shaft support recess 38 opened upward is formed in each of the supports 35*a*, 35*b* for supporting a wind-up shaft 36. Three support rollers 39 are rotatably arranged inside the shaft support recess 38. The wind-up shaft 36 is rotatably and detachably supported by the support rollers 39.

A wind-up drive gear 40 is disposed under the shaft support recess 38 of the support 35*a*. One end of the wind-up shaft 36 is provided with a wind-up follower gear 42 engaged with the wind-up drive gear 40. The wind-up shaft 36 is rotated/operated via the wind-up follower gear 42 by rotating/operating the wind-up drive gear 40.

The operation of the first embodiment will next be described.

In the ink jet printer of the first embodiment, a recording sheet is fed between the platen 5 and the ink jet recording head 10 by a sheet feeding mechanism (not shown). Moreover, the carriage 8 is reciprocated along the carriage shafts 7 by operating the carriage drive belt 9. On the other hand, the piezoelectric element of the ink jet recording head 10 is operated on the basis of a predetermined recording signal to eject ink from the ejecting nozzle 12. A desired image is thus recorded on the recording sheet.

The wind-up drive gear 40 is rotated/operated in synchronization with the feeding operation of the sheet feeding device, and the wind-up shaft 36 is rotated/operated via the wind-up follower gear 42. Since the recorded sheet is wound up by the wind-up shaft 36, the recorded sheet is prevented from wrinkling or creasing.

During the recording, the voltage across both ends of each piezoelectric element corresponding to each ejecting nozzle 12 is detected by the voltage detecting means 26. The voltage generated by each piezoelectric element is transmitted to the non-ejection detecting means 28 from the voltage detecting means 26, and the non-ejection detecting means 28 detects which of the ejecting nozzles 12 is in the non-ejection state. During the recording, when the ink supply passage of the ink jet recording head 10 is clogged, or air bubbles are generated to cause non-ejection of the ink from the ejecting nozzle 12, the non-ejection detecting means 28 detects the ejecting nozzle from which the ink is not ejected, and transmits to the control means 29 a non-ejection signal indicating which of the ejecting nozzles 12 is in the non-ejection state.

When the non-ejection signal is transmitted to the control means 29, the control means 29 stops the recording, returns the carriage to its home position, and performs the restoring operation of the ink non-ejection condition. Specifically, in the home position the cap 33 is attached to and covers the ejecting nozzle 12. Thereafter, while an atmospheric air release valve (not shown) of the cap 33 is opened, the flowing ink is sucked under a negative pressure. Additionally, as shown in FIG. 4B, the pressurizing means 19 is operated.

Subsequently, the air is supplied into the ink tank 16 via the pressure junction section 20 and the pressurizing air channel 22, and the ink in the ink supply passage is pressurized. FIG. 4A indicates the inner pressure of the ink supply passage detected by the pressure measuring means 23. As shown in FIG. 4A, the inner pressure of the ink supply passage is set to about 1.35 atm (set pressure value) as shown by point A1 of FIG. 4A, which exceeds 1.3 atm (constant pressure value).

Figures 4A, 4B, 4C, 4D, 4E, 4F:
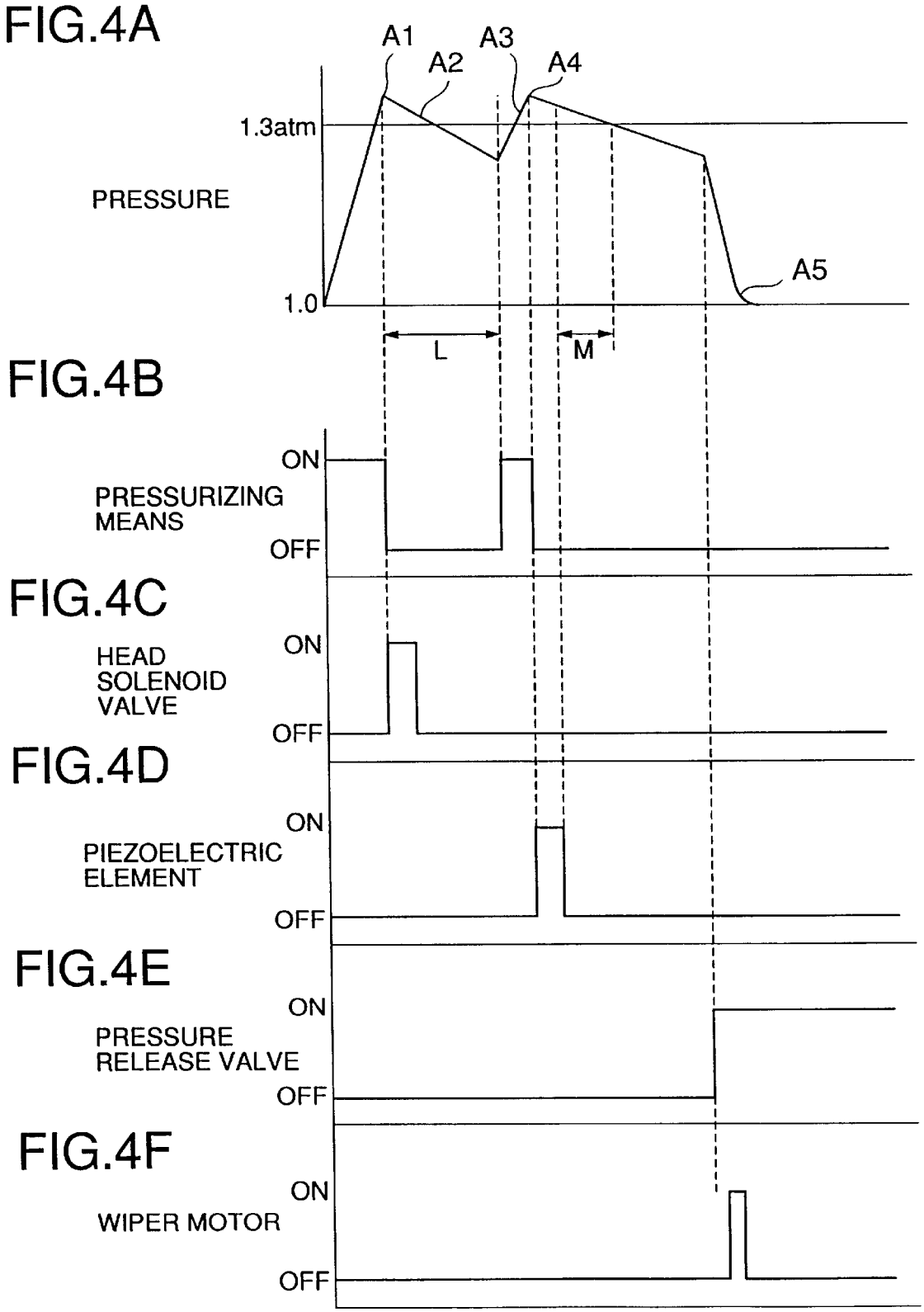
FIGS. 4(A)–(F) illustrate a timing chart for restoring the ink non-ejection condition according to a first embodiment of the present invention.

Subsequently, as shown in FIG. 4C, the control means 29 turns on or opens the head solenoid valve 13. Through the operation the air is exhausted from the buffering chamber 12*a* to make the air amount constant, and the pressure inside the buffering chamber 12*a* is adjusted. Since the air is exhausted from the buffering chamber 12*a*, and the ink flows to the cap 33 from the ejecting nozzle 12, the pressure in the ink jet recording head 10 is lowered as shown by A2 of FIG. 4A.

Thereafter, in order to compensate for the decreased pressure, as shown by FIG. 4B, the control means 29 operates the pressurizing means 19 again, supplies air into the ink tank 16 via the pressure junction section 20 and the pressurizing air channel 22, and pressurizes the ink tank as shown by A3 of FIG. 4A. Specifically, a period until the pressurizing means 19 is operated again (period L in FIG. 4A) serves as a period for adjusting the amount of air of the buffering chamber 12*a*.

When the inner pressure of the ink supply passage is increased again up to about 1.35 atm (set pressure value), the pressurizing is stopped (point A4 of FIG. 4A) and, as shown in FIG. 4D, and the control means 29 operates the piezoelectric element with about twice the voltage for ordinary recording, so that the ink is ejected from the ejecting nozzle 12 under high pressure. The foreign particles or air bubbles adhering inside the ejecting nozzle 12 are peeled off by pulsation at this time, and ejected into the cap 33 together with the ink.

After the high pressure ejection is performed as described above, as shown in FIG. 4E, the pressure release valve 24 is opened to release the pressure of the pressurizing means 19, and the internal pressure of the pressure junction section 20 is adjusted to an atmospheric pressure (A5 of FIG. 4A). In this case, as shown in FIG. 4F, the wiper motor 15 is operated to rock the wiper 14 of each ejecting nozzle 12 before the pressure is completely lowered down to the atmospheric pressure. The ink is wiped off from the nozzle port of the ejecting nozzle 12 in this manner.

On the other hand, when the inner pressure of the ink tank 16 is increased by the pressurizing means 19, the presence of ink in the ink supply passage is simultaneously judged by the remaining ink judgment means 30. Specifically, after the inner pressure of the ink supply passage is raised up to about 1.35 atm by the pressurizing means 19 (about one second elapses after 1.3 atm is detected), and two seconds elapse after the completion of pressurizing (point A4 of FIG. 4A), it is detected whether the pressure is above or below 1.3 atm. When it is more than 1.3 atm, it is judged that there is remaining ink. When it is less than 1.3 atm, it is judged that there is no remaining ink. A period M shown in FIG. 4A is a period for judging the presence of remaining ink.

When the judgment is repeated predetermined times, and it is finally judged that there is no remaining ink, the remaining ink display means 32 indicates an error display or emits an alarming sound to inform the user. Moreover, a signal is transmitted to the control means 29 to stop the restoring operation.

Therefore, according to the first embodiment, the ink jet recording head 10 having caused the ink non-ejection by the foreign particles or air bubbles adhering thereto can securely be restored.

Moreover, since the judgment of the presence of the ink remaining in the ink tank 16 can be made using the restoring apparatus, the structure is simple and requires little manufacturing cost. Additionally, the disposal of the ink tank 16 is not troublesome.

A second embodiment of the present invention will next be described. Additionally, the structure of the second embodiment equivalent to or corresponding to the structure of the first embodiment is denoted with the same reference and codes, and the description thereof is omitted.

In the first embodiment, when the non-ejection detecting means 28 outputs the non-ejection signal indicating the ink non-ejection of a certain ejecting nozzle 12, the control means 29 performs the restoring operation for all the ejecting nozzles 12 including nozzles not in the non-ejection state. The second embodiment is different from the first embodiment in that the restoring operation is applied only to the ejecting nozzle 12 placed in the ink non-ejection state.

The second embodiment will be described in more detail with reference to FIG. 5. For example, a case in which the ejecting nozzle 12 of the ink jet recording head 10 for black ink is placed in the non-ejection state is assumed. FIG. 5A shows a pressure applied to the normally operated ink jet recording head for the inks other than the black ink, while FIG. 5A*bk* shows a pressure applied to the non-ejecting ink jet recording head for the black ink. In this case, the tank solenoid valve 25 of the black ink is first kept off or opened, and the tank solenoid valves 25 for the other inks (yellow, magenta, cyan) are turned on or closed (FIGS. 5G and 5H). Only the ink tank 16 of the black ink is connected to the pressurizing means 19 in this manner.

Figures 5A, 5B, 5C, 5D, 5E, 5F, 5G, 5H:
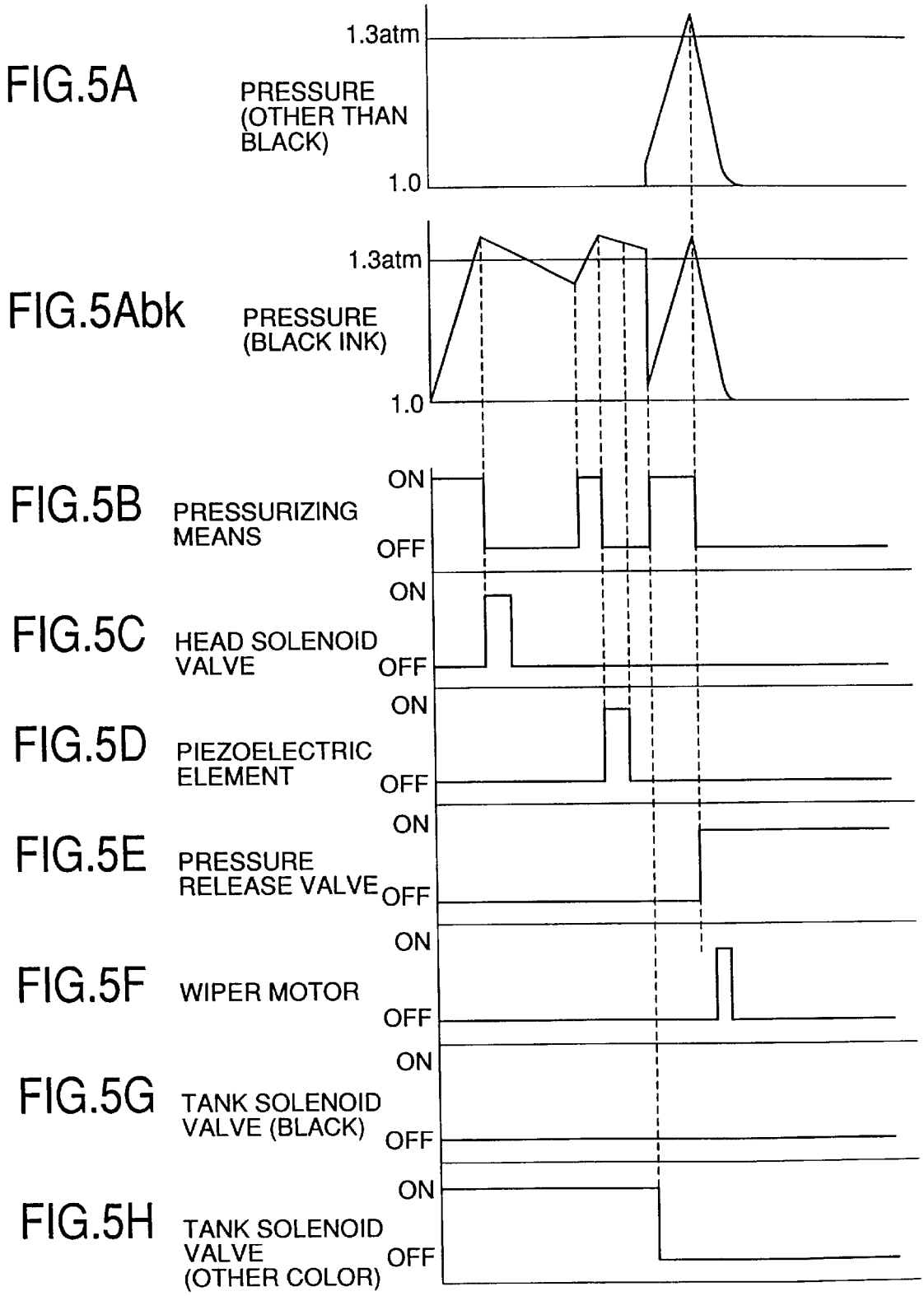
FIGS. 5(A)–(H) illustrate a timing chart for restoring the ink non-ejection condition according to a second embodiment of the present invention.

In this condition, the pressurizing means 19 is operated, and air is supplied into the ink tank 16 of the black ink via the pressure junction section 20 and the pressurizing air channel 22 (FIG. 5B). Subsequently, the inner pressure of the ink supply passage for the black ink is raised up to 1.35 atm (set pressure value). Subsequently, only the head solenoid valve 13 for the ejecting nozzle 12 of the black ink is opened (FIG. 5C), and the amount of air in the buffering chamber 12*a* of the ink jet recording head for the black ink is adjusted to be constant.

Thereafter, since the amount of air in the buffering chamber 12*a* corresponding to the black ink is adjusted and the ink flows out of the ejecting nozzle 12, the inner pressure of the ink jet recording head 10 is lowered (FIG. 5A*bk*). Then, the pressurizing means 19 is operated again, air is supplied into the ink tank 16 of the black ink, and the inner pressure of the ink supply passage is raised up to the set pressure value of 1.35 atm. Moreover, the piezoelectric element is allowed to pulsate with the voltage twice the ordinary voltage, and the foreign particles or air bubbles adhering to the ejecting nozzle 12 of the black ink are ejected together with the ink under high pressure (FIG. 5D).

After the ink jet recording head 10 for the black ink is recovered from the non-ejection condition in this manner, the pressurizing means 19 is operated again, and the tank solenoid valves 25 for the inks other than the black ink are turned off or opened (FIG. 5H), and the ink tanks 16 are pressurized. Subsequently, the ink is ejected from all the ink jet recording heads 10, and the ejection faces of the ejecting nozzles 12 are cleaned by the wipers 14 (FIG. 5F).

As described above, after the restoring operation, the ink is ejected from all the ink jet recording heads 10. This is because the wipers 14 in the second embodiment are operated by one wiper motor 15. Specifically, the operation of only the wiper 14 for the black ink is not realized. Unless the ink is ejected from all the ejecting nozzles 12, the ejection faces for the other colors may be damaged. Therefore, if the wiper 14 for each color is connected to the wiper motor 15 operated separately and independently, only the wiper 14 for the black ink may be operated to lower the pressure after the high-pressure ejection.

Consequently, according to the second embodiment, in addition to the effect of the first embodiment, there is provided an effect that the wasteful consumption of ink can be minimized, because the high-pressure ejection for the restoring operation of the normally ejecting ink jet recording head 10 is not performed.

Additionally, the present invention is not limited to the aforementioned embodiments, and can variously be modified as required. For example, the solenoid valves are used in the head solenoid valves, tank solenoid valves and pressure release valve because the valves can easily and securely be opened/closed by electromagnetic action, but the valves are not limited to these and may be opened/closed by another means.

As described above, according to the apparatus for restoring the ink jet recording head of the present invention, when the ink non-ejection condition is detected, the control means adjusts the inner pressure of the ink passage of the ink jet recording head to the set pressure value. Therefore, the air bubbles or foreign particles can securely be removed from the ink jet recording head, so that the ink jet recording head is recovered from the non-ejection condition.

Moreover, when a plurality of ink jet recording heads are independently detected for the ink non-ejection condition, and the ink is ejected only from the non-ejecting ink jet recording head for the restoring operation, the wasteful consumption of the ink can be minimized.

What is claimed is:

1. An apparatus for restoring an ink jet recording head which performs image recording by ejecting ink droplets to a recording sheet from an ejecting nozzle of the ink jet recording head, comprising:

a non-ejection detector for detecting an occurrence of non-ejection of the ink droplets from the ejecting nozzle to output a non-ejection signal;

a pressurizing device for increasing an inner pressure of an ink supply passage connected to said ink jet recording head during both a normal and a restoring operation;

a pressure measuring device for detecting the inner pressure of said ink supply passage during both the normal and the restoring operation; and a controller-for controlling said pressurizing device based on said non-ejection signal in such a manner that the inner pressure of the ink supply passage detected by said pressure measuring device reaches a set pressure value to eject ink.

2. The restoring apparatus according to claim 1, said ink jet recording head comprising a piezoelectric element disposed adjacent the ink supply passage;

wherein a voltage device applies drive voltage to the piezoelectric element to deform the piezoelectric element, and the inner pressure of the ink supply passage is increased to eject the ink.

3. The restoring apparatus according to claim 2, wherein said non-ejection detector monitors a change of a voltage generated when the piezoelectric element is deformed by a change of the inner pressure of the ink supply passage immediately after ink ejecting operation, and determines ejection/non-ejection by referring to the change of the generated voltage.

4. The restoring apparatus according to claim 2, wherein after the inner pressure of the ink supply passage is increased to the set pressure value in response to the non-ejection signal, the controller actuates said piezoelectric element to eject the ink.

5. The restoring apparatus according to claim 4, wherein the drive voltage of the piezoelectric element at a restoring operation is set higher than a drive voltage at the time of normal operation.

6. The restoring apparatus according to claim 1, comprising a remaining ink judgment device for receiving an output of said pressure measuring device to monitor a decreasing rate of the inner pressure of the ink supply passage after the inner pressure of the ink supply passage is increased to a predetermined pressure value by said pressurizing device in the restoring operation, and judging a presence of remaining ink in the ink supply passage on the basis of a magnitude of the decreasing rate.

7. The restoring apparatus according to claim 1, said ink jet recording head comprising:

a buffering chamber communicated with the ink supply passage for separating air bubbles contaminated in the ink; and a head solenoid valve for exhausting air from the buffering chamber;

wherein, prior to the restoring operation, the controller starts the pressurizing device based on the non-ejection signal to raise the inner pressure of the ink supply passage, opens the head solenoid valve, and adjusts an amount of air in said buffering chamber.

8. The restoring apparatus according to claim 1, further comprising a wiper for cleaning a nozzle face of the ejecting nozzle;

wherein said controller opens a pressure release valve for releasing the inner pressure of the ink supply passage after completing the restoring operation, and then actuates said wiper.

9. The restoring apparatus according to claim 1, wherein said pressurizing device is formed by a pressurizing pump for supplying pressurizing air to an ink tank communicated with the ink jet recording head; and wherein said pressure measuring device includes a pressure sensor for detecting an air pressure in a pressurizing air channel connecting said pressurizing pump and the ink tank.

10. The restoring apparatus according to claim 1, comprising:

a plurality of ink jet recording heads for recording different colors;

a plurality of ink tanks corresponding to the ink jet recording heads;

a pressure junction section which is pressurized by one pressurizing pump;

tank solenoid valves provided in a plurality of pressurizing air channels connecting the pressure junction section and the plurality of ink tanks;

a pressure sensor for detecting a pressure of said pressure junction section, said pressure sensor being used as said pressure measuring device; and a pressure release valve for releasing the inner pressure of said pressure junction section.

11. The restoring apparatus according to claim 10, wherein said non-ejection detector independently detects ink non-ejection condition of the plurality of ink jet recording heads, and the controller performs the restoring operation for the ink jet recording head placed in the ink non-ejection condition.

12. An apparatus for restoring an ink jet recording head, comprising:

a non ejection detector for detecting ink non-ejection from each of a plurality of ejecting nozzles of a plurality of ink jet recording heads to output a non-ejection signal;

a pressurizing device for increasing an inner pressure of an ink supply passage during both a normal and a restoring operation; and a controller for, when the non-ejection signal of any one of the ejecting nozzles is transmitted from said non-ejection detector, operating said pressurizing device to increase the inner pressure of the ink supply passage to eject ink from said one of the ejecting nozzles;

wherein the inner pressure of the ink supply passage increased by an action of said pressurizing device is adjusted to a set pressure value by said controller.

13. The restoring apparatus according to claim 12, wherein after the inner pressure of the ink supply passage increased by operating said pressurizing device is once lowered, said controller again operates said pressurizing device to increase the inner pressure of the ink supply passage to the set pressure value prior to returning the ink jet recording head to normal operation.

14. The restoring apparatus according to claim 12, wherein said controller controls said pressurizing device to increase to the set pressure value the inner pressure only of the ink supply passage for the ejecting nozzle whose non-ejection signal is outputted by said non-ejection detector.

15. An ink jet printer for supplying ink to an ink jet recording head from an ink tank, and ejecting ink droplets to a recording sheet from the ejecting nozzle on the basis of a predetermined recording signal to perform recording, comprising:

a restoring apparatus, comprising:

a non-ejection detector for detecting an occurrence of non-ejection of the ink droplets from the ejecting nozzle to output a non-ejection signal;

a pressurizing device for increasing an inner pressure of an ink supply passage connected to said ink jet recording head during both a normal and a restoring operation;

a pressure measuring device for detecting the inner pressure of said ink supply passage during both the normal and the restoring operation; and a controller for controlling said pressurizing device based on said non-ejection signal in such a manner that the inner pressure of the ink supply passage detected by said pressure measuring device reaches a set pressure value to eject ink;

a platen;

a carriage for supporting the ink jet recording head; and a conveyor for conveying said recording sheet between the platen and the ink jet recording head.

16. An apparatus for restoring an ink jet recording head which performs image recording by ejecting ink droplets to a recording sheet from an ejecting nozzle of the ink jet recording head, comprising:

a non-ejection detector for detecting an occurrence of non-ejection of the ink droplets from the ejecting nozzle to output a non-ejection signal;

a pressurizing device for increasing an inner pressure of an ink supply passage connected to said ink jet recording head;

a pressure measuring device for detecting the inner pressure of said ink supply passage;

a controller for controlling said pressurizing device based on said non-ejection signal in such a manner that the inner pressure of the ink supply passage detected by said pressure measuring device reaches a set pressure value to eject ink; and a remaining ink judgment device for receiving an output of said pressure measuring device to monitor a decreasing rate of the inner pressure of the ink supply passage after the inner pressure of the ink supply passage is increased to a predetermined pressure value by said pressurizing device in a restoring operation, and judging a presence of remaining ink in the ink supply passage on the basis of a magnitude of the decreasing rate.

17. An apparatus for restoring an ink jet recording head which performs image recording by ejecting ink droplets to a recording sheet from an ejecting nozzle of the ink jet recording head, comprising:

a non-ejection detector for detecting an occurrence of non-ejection of the ink droplets from the ejecting nozzle to output a non-ejection signal;

a pressurizing device for increasing an inner pressure of an ink supply passage connected to said ink jet recording head;

a pressure measuring device for detecting the inner pressure of said ink supply passage; and a controller for controlling said pressurizing device based on said non-ejection signal in such a manner that the inner pressure of the ink supply passage detected by said pressure measuring device reaches a set pressure value to eject ink;

wherein said ink jet recording head comprises:

a buffering chamber communicated with the ink supply passage for separating air bubbles contaminated in the ink; and a head solenoid valve for exhausting air from the buffering chamber, wherein, prior to a restoring operation, the controller starts the pressurizing device based on the non-ejection signal to raise the inner pressure of the ink supply passage, opens the head solenoid valve, and adjusts an amount of air in said buffering chamber.

18. An apparatus for restoring an ink jet recording head which performs image recording by ejecting ink droplets to a recording sheet from an ejecting nozzle of the ink jet recording head, comprising:

a non-ejection detector that detects an occurrence of non-ejection of the ink droplets from the ejecting nozzle to output a non-ejection signal;

a pressurizing device that increases an inner pressure of an ink supply passage connected to said ink jet recording head;

a pressure measuring device that detects the inner pressure of said ink supply passage; and a controller that initiates a restoring operation for said ink jet recording head based on said non-ejection signal, the restoring operation being different from a normal operation of said ink jet recording head, wherein during the restoring operation the controller activates said pressurizing device a first time to increase the inner pressure of the ink supply passage to a first set pressure value, pauses said pressurizing device for a first period of time during which the inner pressure of the ink supply passage drops, and activates said pressurizing device a second time to increase the inner pressure of the ink supply passage to a second set pressure value prior to returning said ink jet recording head to the normal operation.

19. The apparatus according to claim 18, further comprising a buffering chamber for said ink jet recording head and a head solenoid valve connected thereto, and wherein said controller activates said solenoid valve to bleed air from said buffering chamber during the first period of time.

20. The apparatus according to claim 18, further comprising a mechanical-electrical device in said ink jet recording head for ejecting ink therefrom, and wherein said controller activates said mechanical-electrical device after activating said pressurizing device the second time prior to returning said- ink jet recording head to the normal operation.

21. The apparatus according to claim 20, wherein said mechanical-electrical device is a piezoelectric device, and wherein said controller activates said mechanical-electrical device to operate at a restoring operation voltage that is greater than a voltage at which said mechanical-electrical device operates during normal operation.

22. The apparatus according to claim 18, further comprising a remaining ink judgement device that judges a presence of remaining ink in the ink supply passage on the basis of a decreasing rate of pressure in the ink supply passage.

* * * * *